US010233821B2

(12) United States Patent
Spiess et al.

(10) Patent No.: US 10,233,821 B2
(45) Date of Patent: Mar. 19, 2019

(54) METHOD FOR MONITORING THE STATE OF OPENING OF A CONTROL VALVE OF A COOLANT CIRCUIT OF AN INTERNAL COMBUSTION ENGINE, AND DEVICE FOR THE SAME

(71) Applicants: Bayerische Motoren Werke Aktiengesellschaft, Munich (DE); BorgWarner Esslingen GmbH, Esslingen (DE)

(72) Inventors: Thomas Spiess, Munich (DE); Norbert Dembinski, Munich (DE); Gerhard Sellmair, Munich (DE)

( * ) Notice: Subject to any disclaimer, the term of this patent is extended or adjusted under 35 U.S.C. 154(b) by 161 days.

(21) Appl. No.: 15/309,203

(22) PCT Filed: Apr. 15, 2015

(86) PCT No.: PCT/EP2015/058128
§ 371 (c)(1),
(2) Date: Nov. 6, 2016

(87) PCT Pub. No.: WO2015/169551
PCT Pub. Date: Nov. 12, 2015

(65) Prior Publication Data

US 2017/0198628 A1 Jul. 13, 2017

(30) Foreign Application Priority Data

May 7, 2014 (DE) ..... 10 2014 106 362

(51) Int. Cl.
*F01P 7/16* (2006.01)
*F01P 7/14* (2006.01)

(52) U.S. Cl.
CPC ..... *F01P 7/167* (2013.01); *F01P 2007/146* (2013.01); *F01P 2037/02* (2013.01)

(58) Field of Classification Search
CPC ... F01P 7/167; F01P 2037/02; F01P 2007/146
See application file for complete search history.

(56) References Cited

U.S. PATENT DOCUMENTS

| | | | | |
|---|---|---|---|---|
| 6,539,899 | B1 | 4/2003 | Piccirilli et al. | |
| 9,759,122 | B2 * | 9/2017 | Aydin | F01P 7/16 |
| 2004/0187805 | A1 * | 9/2004 | Arisawa | F01P 7/162 123/41.14 |

FOREIGN PATENT DOCUMENTS

| | | | |
|---|---|---|---|
| DE | 199 48 249 | A1 | 4/2001 |
| DE | 199 60 190 | A1 | 7/2001 |
| DE | 10 2011 003 430 | B3 | 5/2012 |
| DE | 10 2012 210 320 | B3 | 9/2013 |
| DE | 10 2012 018 255 | A1 | 3/2014 |

(Continued)

*Primary Examiner* — Kevin A Lathers
(74) *Attorney, Agent, or Firm* — Rod D. Baker

(57) ABSTRACT

An apparatus and method for monitoring the state of opening of a control valve of a coolant circuit of a combustion engine. There is disclosed a method of a control valve of a coolant circuit of a combustion engine, with the control valve having a valve element that is actuatable by an actuator for enabling and/or blocking a coolant flow in the coolant circuit which has a heat exchanger, and having an assembly for detecting the position of the valve element for monitoring the opening state of the control valve. There also is provided an apparatus for carrying out the method.

12 Claims, 5 Drawing Sheets

(56) References Cited

FOREIGN PATENT DOCUMENTS

Figure 1:
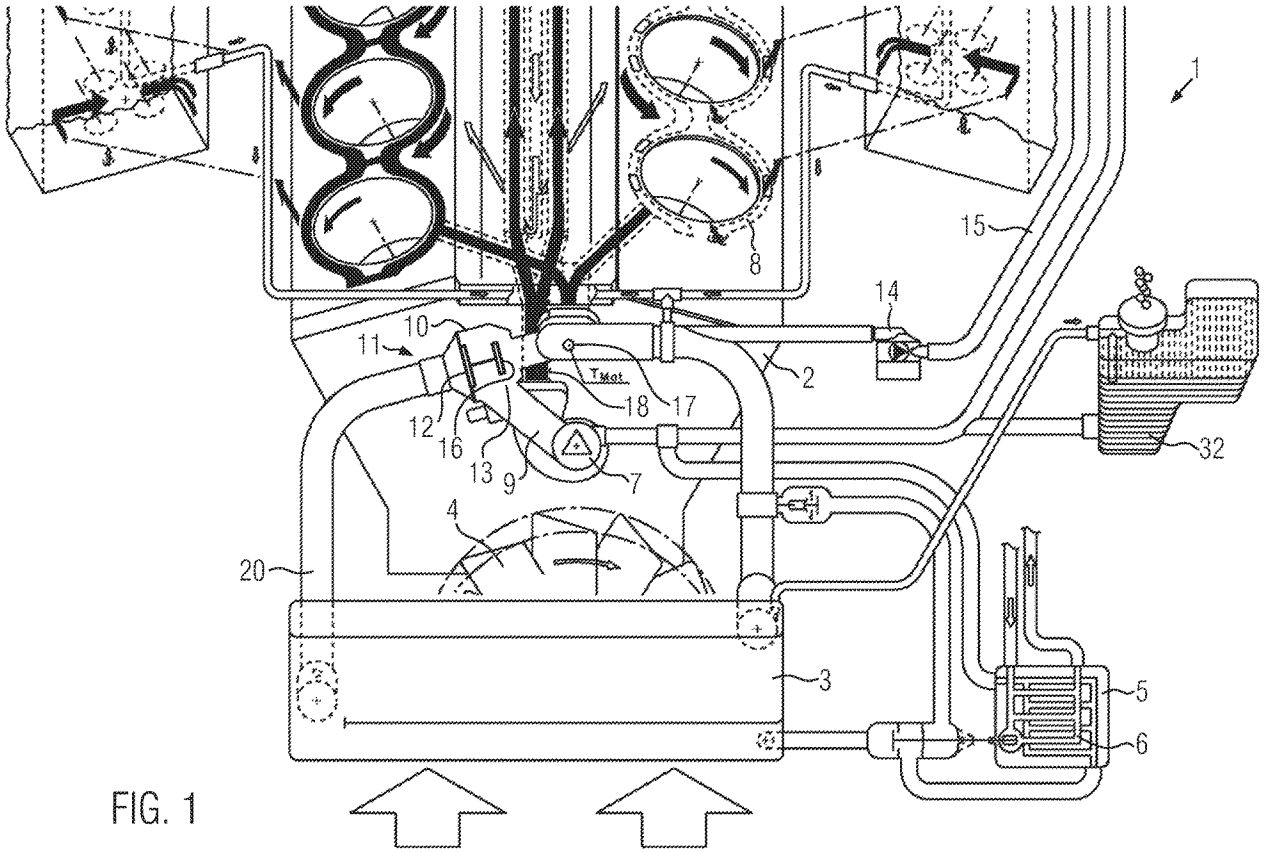

| | | | |
|---|---|---|---|
| EP | 2 401 499 | B1 | 10/2013 |
| WO | 2003 042514 | A1 | 5/2003 |
| WO | 2015169551 | A1 | 11/2015 |

* cited by examiner

METHOD FOR MONITORING THE STATE OF OPENING OF A CONTROL VALVE OF A COOLANT CIRCUIT OF AN INTERNAL COMBUSTION ENGINE, AND DEVICE FOR THE SAME

CROSS REFERENCE TO RELATED APPLICATIONS

This application is a national phase entry of Patent Cooperation Treaty Application No. PCT/EP2015/058128 filed 15 Apr. 2015, to which priority is claimed and which is incorporated herein by reference, and which Patent Cooperation Treaty application claims priority to German Patent Application No. 10-2014-106362.7, filed 7 May 2014, which also is incorporated herein by reference in its entirely.

BACKGROUND OF THE INVENTION

The present invention relates to an apparatus and method for monitoring the state of opening of a control valve of a coolant circuit of a combustion engine. More specifically, this invention has to do with a method of a control valve of a coolant circuit of a combustion engine, with the control valve having a valve element that is actuatable by an actuator for enabling and/or blocking a coolant flow in the coolant circuit which has a heat exchanger (e.g., a radiator), and having a device for detecting the position of the valve element for monitoring the opening state of the control valve.

The invention also relates to a device for carrying out the method, the device including a thermostatic valve having a valve plate displaceable by means of a spring-loaded positioning element in the coolant passage to or from a heat exchanger of a coolant circuit of a combustion engine, and having a wax element to which heat is applicable by means of an electrically actuatable heating element and which actuates the positioning element, and having a sensor which detects the travelling distance of the valve plate and/or positioning element by contactless means, and with a device for comparing an actual value of the travelling distance with a target value of the travelling distance.

Combustion engines are usually operated with a coolant circuit having a heat exchanger, by means of which the waste heat resulting from the combustion that is not required for the interior air conditioning of the combustion engine-powered vehicle can be released into the environment. If the combustion engine, or car engine, is started, i.e. transferred from the non-powered state into the powered state, the engine undergoes a warm-up process, which should be kept as short as possible.

The motor is thus started, for example, at a coolant temperature which corresponds to the ambient temperature and the temperature of coolant flowing through the engine which can be measured, for example, at the coolant outlet region or another measuring point of the engine by means of a sensor, then increases according to a heating curve, which depends, for example, on the load demanded of the engine.

The coolant circuit of the motor contains a control valve, commonly designated as a thermostat or thermostat valve, which has a valve element in the form of a valve plate or similar, and is provided for controlling the passage of the coolant present in the coolant circuit as it flows through the heat exchanger. During the warm-up phase, the valve element is designed to prevent the flow of coolant through the heat exchanger, the so-called large coolant circuit which comprises the heat exchanger, in other words to keep it closed so that coolant only flows through the so-called small coolant circuit, which comprises the circulation channels of the engine for the flow of coolant through the engine block and cylinder head, and one or more heat exchangers for air conditioning of the vehicle interior.

It is the task of the engine's thermal management system, exercised by a control device such as the engine control unit, to control the heat transport using the coolant regulation system. The thermal management system is designed to ensure on the one hand, sufficient interior air-conditioning of the vehicle and on the other hand to rapidly warm up the engine, in order to reduce pollutants emitted in the combustion during the warm-up procedure and to keep the engine wear caused by cold running of the engine as low as possible.

During the warm-up process therefore, the control valve or thermostatic valve plays an essential role, and its state of opening for the period of time required by the warm-up process is crucial. The control valve is designed to keep the large coolant circuit closed below its intended operating opening temperature, which varies greatly from engine to engine, and thus prevent the dissipation of heat via the heat exchanger during the warm-up process, which contributes to emissions. The polluting emissions of a vehicle type can be a criterion relevant to type approval, and therefore it can be a requirement to monitor the proper functioning of the control valve during operation of the vehicle, for example using the existing diagnostic equipment in the vehicle, i.e. equipment for on-board diagnostics (OBD diagnosis).

The diagnosis of the thermostat is intended to test the heating behaviour of the coolant to determine whether the engine will reach its operating temperature in a reasonable period of time. The correct functioning of the thermostatic valve or control valve is therefore to be monitored and any malfunctions identified.

A malfunction is deemed to be present, inter alia, if the temperature of the coolant has not reached a minimum temperature within a reasonable time, the temperature being stipulated for other vehicle-specific OBD diagnostic procedures. A malfunction is also deemed to exist if the measured coolant temperature does not reach the operating opening temperature of the control valve.

According to a method known by one of the applicants, the function of the control valve in the cooling circuit is monitored by measuring the temperature of the coolant at the coolant outlet region of the engine by means of a coolant outlet sensor. The measured temperature $T_{Mot}$ is compared with a modelled coolant engine temperature, which uses the air mass flow rate as a criterion for the engine load, the ambient temperature as a correction value, and the coolant outlet temperature measured when starting the engine as the starting value for an iteration and as the current modelled coolant engine temperature. Plotted against time, the characteristic curve of the modelled coolant engine temperature for a control valve which is functioning as intended lies a short distance below the actual temperature characteristic of the control valve.

The known method starts after the combustion engine is started, i.e. after the operational state of the combustion engine changes from the non-powered state into the powered state, and determines (inter alia) the modelled temperature as a function of the measured air mass flow and compares this temperature with the actual coolant temperature measured at the coolant outlet area, or any other suitable sensor measuring point, by forming a difference. If the delta between the measured and the modelled temperature is greater than a predefined threshold value, an error bit is set, since the actual measured temperature deviates substantially from the modelled temperature and this is an indication that the control valve is not fully closed at the time at which the coolant is only supposed to flow through the small coolant circuit, which means the situation is that of a control valve which is stuck in the open position.

Such a control valve sticking in the open position causes, due to the dissipation of heat via the heat exchanger to the vehicle environment, that the time required for the warm-up procedure is much longer than the time required by a control valve functioning as intended. This results that the emission of pollutants is greater than the emissions occurring in a control valve functioning as intended. The on-board diagnostic system (OBD system) of the vehicle acknowledges the fault and the driver of the vehicle may be informed by means of an optical signal in the form of a maintenance indication to eliminate the cause of the fault, a control valve sticking open, possibly after reading from the vehicle-internal fault memory.

Although the foregoing method is the one best proven in practice, it has room for improvement. This known method requires the engine to be started for the purpose of measuring the air mass flow rate, and a minimum energy input into the engine coolant for measuring the actual coolant temperature during the warm-up phase, which is limited by an upper temperature threshold value of the coolant of, for example, 80° C.

In patent document DE 199 60 190 A1 a control valve for a control circuit has been disclosed, which can be a coolant circuit of a combustion engine. The control valve has a valve element, which can be adjusted by way of an electric direct current motor or a proportionally acting electromagnet. The position of the control valve can be detected by means of a position measuring device, which has the facility for inductive, capacitive or magnetic distance measurement.

SUMMARY OF THE DISCLOSURE

There is disclosed an apparatus and method for monitoring the state of opening of a control valve of a coolant circuit of a combustion engine. There is disclosed a method of a control valve of a coolant circuit of a combustion engine, with the control valve having a valve element that is actuatable by an actuator for enabling and/or blocking a coolant flow in the coolant circuit which has a heat exchanger (e.g., a radiator), and having a device for detecting the position of the valve element for monitoring the opening state of the control valve.

There also is disclosed an apparatus for carrying out the method, the apparatus including a thermostatic valve having a valve plate displaceable by means of a spring-loaded positioning element in the coolant passage to or from a heat exchanger of a coolant circuit of a combustion engine, and having a wax element to which heat is applicable by means of an electrically actuatable heating element and which actuates the positioning element, and also having a sensor which detects the travelling distance of the valve plate and/or positioning element by contactless means, and with a device for comparing an actual value of the travelling distance with a target value of the travelling distance.

On the basis of the known method described quite previously above, an object of the present invention is to improve the method for monitoring the control valve of a coolant system, and to enable the direct detection of the opening state of the control valve. A device for carrying out the method is also to be provided.

To achieve this object, with regard to the method, the invention has the features specified in the claims. Furthermore, in order to achieve the object with regard to the device, the preferred embodiment of the inventive device includes the features specified in apparatus claims recited hereafter.

BRIEF DESCRIPTION OF THE DRAWING FIGURE

Figure 2:
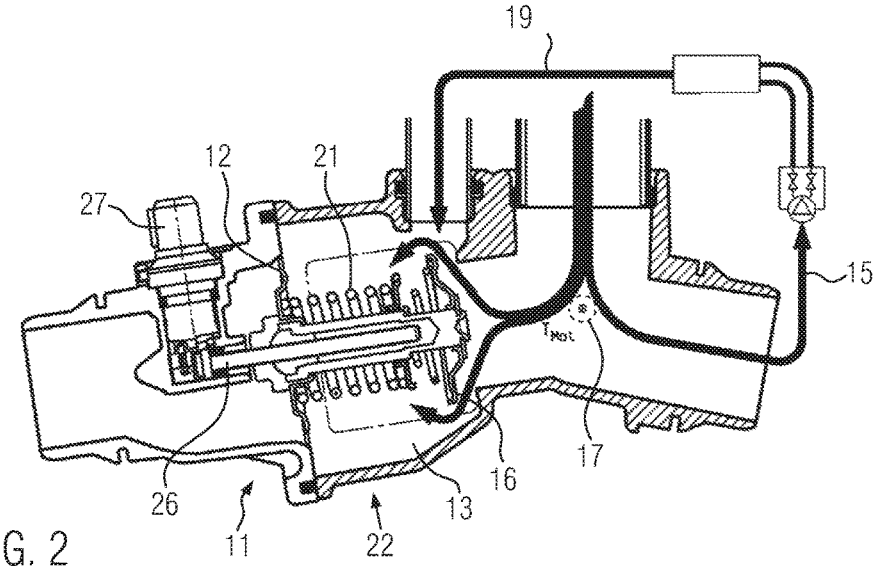
Figure 3:
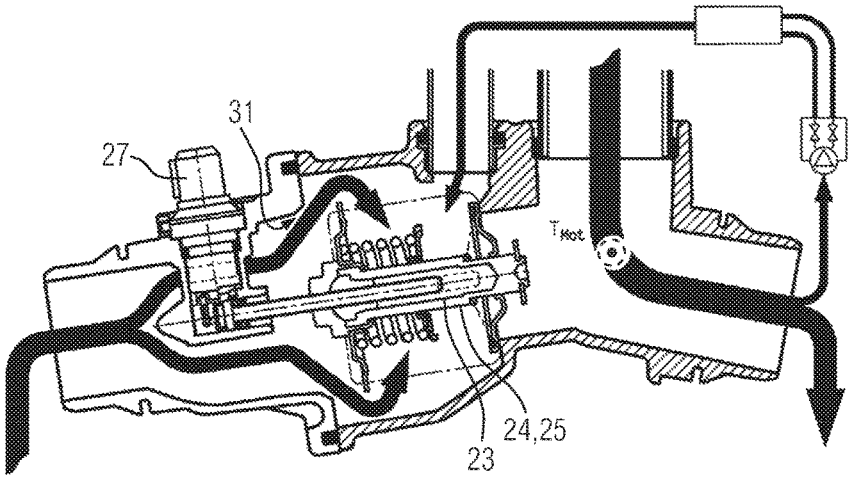
Figure 4:
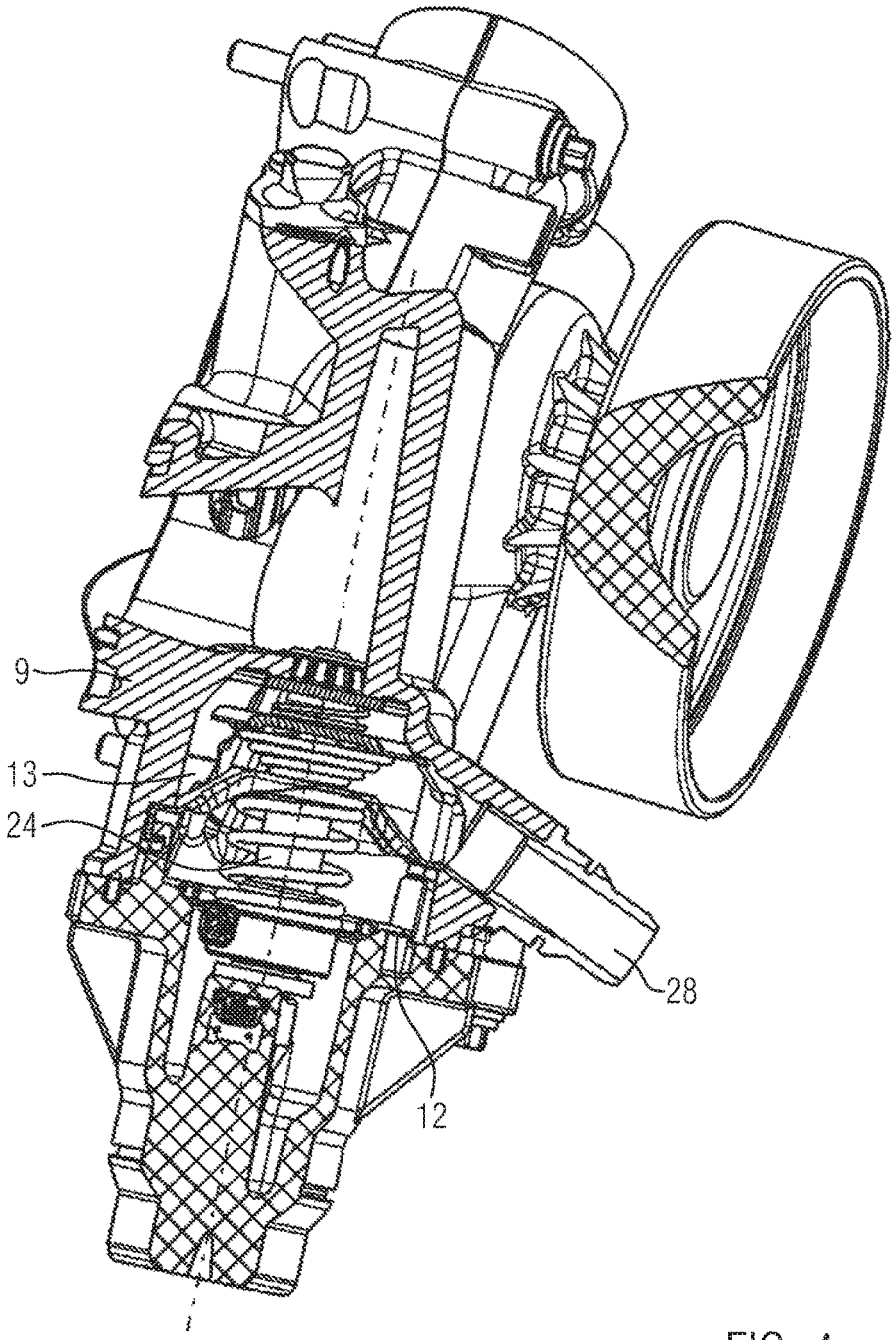
Figure 5:
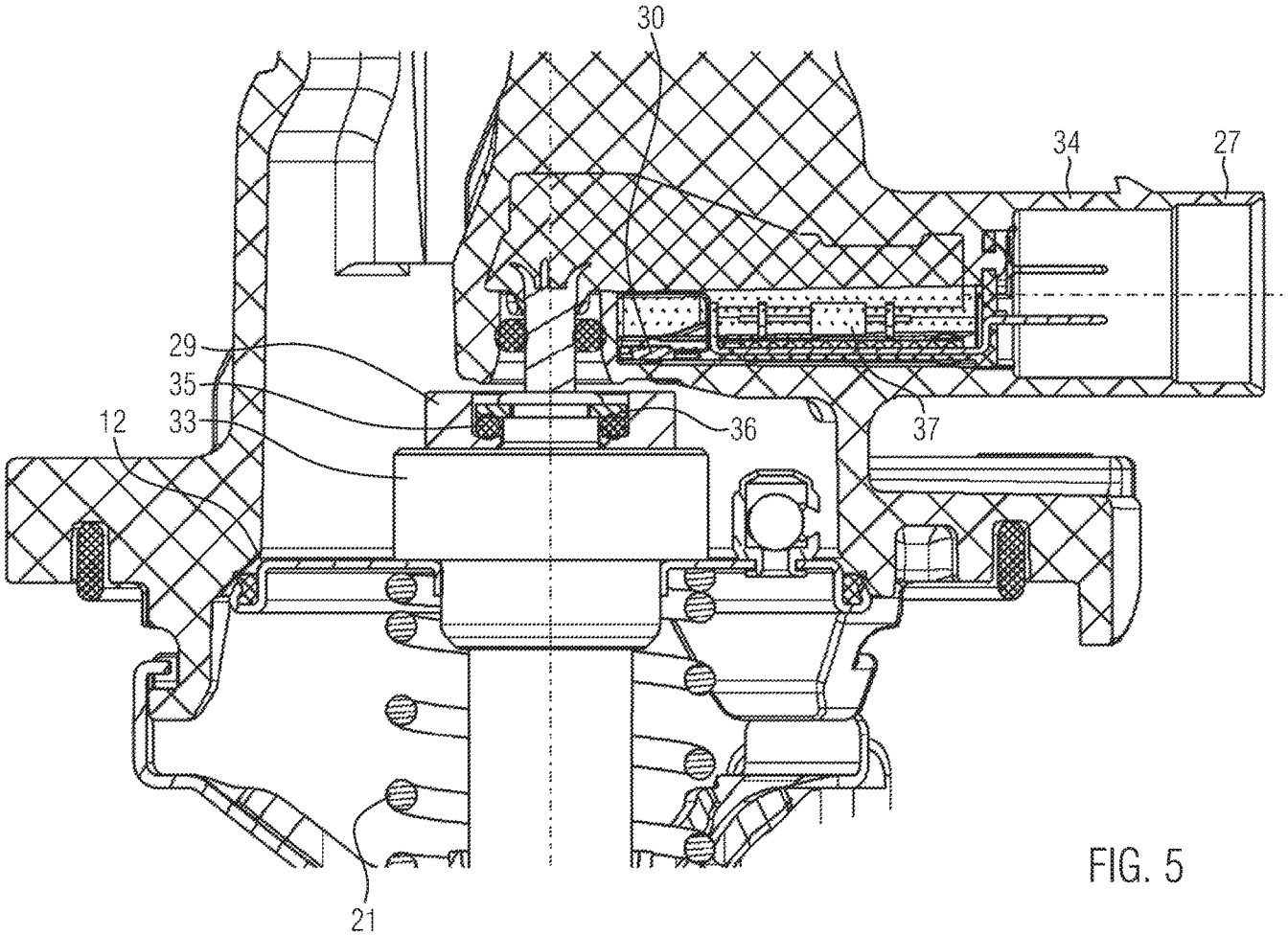
Figure 6:
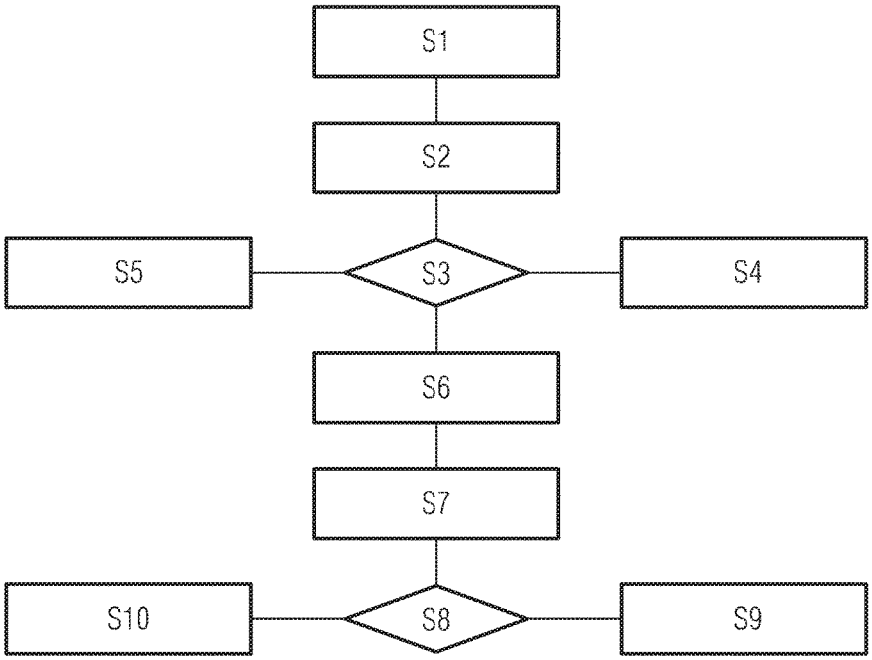

The invention is described in more detail by reference to the drawing. There is shown in:

FIG. 1 a schematic diagram of a coolant circuit of a combustion engine with heat exchanger and coolant pump;

FIG. 2 a sectional view of a thermostatic valve with closed valve plate in the position for warming up the combustion engine;

FIG. 3 a view similar to FIG. 2, with fully displaced valve plate to enable a flow of coolant from the heat exchanger;

FIG. 4 a sectional view of a heatable thermostat valve arranged in the housing of the coolant pump and controlled by an engine map;

FIG. 5 an enlarged view of a detail of the thermostatic valve according to FIG. 4; and FIG. 6 a flow chart for explaining the method according to the invention.

DETAILED DESCRIPTION OF THE VARIOUS EMBODIMENTS

The invention provides a method for monitoring the opening state of a control valve of a coolant circuit of a combustion engine. The control valve has a valve element that is actuatable by an actuator for enabling and/or blocking a coolant flow in the coolant circuit which comprises a heat exchanger, and a device for detecting the position of the valve element, wherein according to the method by the device a first actual value representing the position of the valve element before the starting of the combustion engine is detected, and the actual value is compared with a reference value which corresponds to a blocking position of the valve element.

In other words, the invention provides a method for diagnosing the opening state of a control valve of a coolant circuit of a combustion engine, wherein the control valve has, for example, a valve plate as the blocking element for the coolant flow. The actuator which actuates the valve element can be a wax cartridge or similar, which can also be heated electrically in order to be able to control the position of the valve element independently of the coolant temperature. If a wax cartridge is used as the actuator, this wax cartridge has an actuating pin or similar, which can directly or indirectly operate the valve link in the form of the valve plate when the wax expands due to heating by the coolant. An actuator accordingly can be provided which can actively release the blocking position of the valve element, but cannot actively establish a blocking position, wherein the actuator then operates the valve element against the force of, for example, a return spring. It is also possible to design the actuator to act bidirectionally, so that it can both actively release the blocking position, and bring it about. The position of the valve element can be determined by a position detecting means. According to a method of the invention, a first actual value representing the position of the valve element is detected before the starting of the combustion engine, and is compared with a reference value which corresponds to a blocking position of the valve element. The comparison operation can be carried out by the valve control device itself, or by another device, such as the engine control unit.

In the engine control unit, cited only by way of example, a reference value for the blocking position of the valve element is stored, which is compared with the actual value of the position of the valve element, which is detected before starting the combustion engine. This reference value can be, for example, a voltage value which is output by a sensor. A changing position of the valve element then corresponds to a changing voltage value. Before the combustion engine is started, a voltage value which corresponds to the actual value of the position is then output by the sensor, which is compared with the voltage value known to correspond to the blocking position of the valve element. By forming or calculating a difference between the actual value and the reference value, it can then be determined prior to the combustion engine being started whether the valve plate is in its blocking position.

The starting of the combustion engine corresponds to the state in which, or the time at which, the combustion engine is transferred from the non-powered state into the powered state, i.e., for example, it is set into independent operation by means of an electric starter motor. The actual value of the position of the valve element before the starting of the combustion engine is therefore compared with a reference value which corresponds to a blocking position of the valve element, a position in which the valve element blocks a flow branch for the coolant of the combustion engine towards the heat exchanger or from the heat exchanger towards the combustion engine, i.e. a flow motion of coolant through the heat exchanger is prevented.

Such a flow motion would in the case of a non-blocking valve element be brought about by the coolant pump, which is normally present in the coolant circuit. If the valve element is non-blocking condition, during the warm-up phase an unwanted release of heat is caused through the heat exchanger—which would mean the warm-up process would take much longer.

A method according to the invention therefore enables the monitoring of the opening state of the control valve or thermostatic valve, or thermostat, in the coolant circuit of a combustion engine up to a point in time before the engine is actually started; and so the method according to the invention offers the advantage of emission-free monitoring of the opening state of the control valve. The method thus enables the diagnosis of the position of the valve element before the engine is started, and therefore before any emission of pollutants occurs.

According to an extension or further development of the invention, it is provided that in the event of deviation of the actual value from the reference value, an error entry is recorded in a fault memory, and so the method according to the invention is designed for the on-board diagnosis of vehicles. Besides recording a fault in the vehicle's internal fault memory, a clearly legible warning or indication also can be output on a vehicle-internal display device for the user of the vehicle. Because the reference value corresponds to the blocking position of the valve element, a difference between the reference value and the actual value is an indication of a stuck-open thermostatic valve. According to the method of the disclosed invention, the stuck-open condition can be detected without any emission of pollutant during the diagnostic process.

It is also provided according to an extension or further development of the inventive method that, before starting the combustion engine, the valve element is actuated to produce a change in the position of the valve element, which change is detectable by the device. This means that it is also provided according to the invention to control the actuator to produce a change in the position of the valve element relative to the sensor, even before the engine is powered up. Sufficient for this purpose is a change in the position of the valve element by a distance which corresponds to the resolution accuracy of the device, or sensor, which detects the position of the valve element. A minimum deflection of the valve element is therefore sufficient to determine that the valve element is free to move, that is to say, it can be moved by the actuator.

This extension or further development of the method according to the invention has the advantage that, as well as being able to verify that the valve element is in a blocking position before the combustion engine is started, i.e. it is not the case that the valve element is stuck open, it can also be verified whether the valve element is in fact in its blocking position but cannot be released from the blocking position. By way of a short displacement movement of the valve element, in the range of the resolution accuracy of the detecting device, the ability of the valve element to move freely (to be released from the blocking position) can be diagnosed. This movement can be small enough that an elastomer component, provided on the valve element and resting against a through-passage of the thermostatic valve for the coolant, ensures that the passage continues to remain closed, and in this way both the proper blocking position of the valve element is able to be verified, as well as the fact that the valve element is not stuck in a closed position can be verified. This enables the proper functioning of the valve element to be verified, both with regard to its blocking position and to its pass-through function. The risk of overheating of the combustion engine due to a valve element sticking in the closed position therefore can also be avoided.

It is also provided according to an extension or further development of the method according to the invention that a target value corresponding to the modified position of the valve element is compared with a modified actual value which is detected by the device, and if the target value deviates from the actual value a fault entry is recorded in a fault memory. This extension enables the advantage of a dual functionality to be achieved. This is because on the one hand, it allows the function of the actuator which was controlled to change the actual position of the valve element to be inspected, and on the other hand, it also allows the distance measurement to be referenced to the valve element (by the position target value being compared with the actual value measured by the distance measurement device, and the distance measurement being diagnosed as correct if the actual value lies within a tolerance window which includes the target value).

It is also provided according to an extension or further development of the method according to the invention, that the temperature of the coolant is detected and the first actual value is detected at least until the temperature has reached a predetermined temperature threshold. If the actuator controls the valve element as a function of the temperature of the coolant relative to the opening, and if at a temperature above the predetermined temperature threshold value the valve element is in an open position when used as intended, this corresponds to a proper functioning of the valve element, and the first actual value no longer needs to be measured.

A method according to the invention is also advantageously further developed by the fact that the valve element is actuated by the actuator if a coolant temperature detected in the coolant circuit is below a predetermined threshold value. The threshold value can have a value less than or equal to a normal operating opening temperature, subject to a tolerance range, of the valve element. Therefore, as long as the measured coolant temperature is below the operating opening temperature of the valve element of, for example, 105 degrees Celsius, subject to a tolerance of, for example, 5 degrees Celsius, a blocking position of the valve element can be detected even in a coolant circuit which is almost at the operating opening temperature; thus the pulsing of the actuator can be carried out to achieve a minimum distance change of the valve element. This means that even in vehicles which operate with a start-stop system, the method according to the invention can be used to verify the blocking position of the valve element, for example, during a red light phase, and it can also be verified that the actuator is operating as intended and the distance measuring system of the facility can be referenced.

This allows a method according to the invention also to be usable when the combustion engine has almost completed the actual engine warm-up procedure, but coolant is flowing around the valve element at a temperature lower than the normal operating opening temperature of the valve element. This also means that the referencing of the distance measuring system, with which the position of an actuating element of the actuator which actuates the valve element is determined, can be carried out during a short start-stop phase, for example.

In accordance with an advantageous extension of a method according to the invention, it is also provided that the operating state of a coolant pump supplying coolant to a charging device of the combustion engine is detected, and the valve element is actuated by the actuator depending on the detected operating state to induce an opening position of the valve element. The charging device can be, for example, an exhaust gas turbocharger, whose bearing seat is actively cooled with coolant from the coolant circuit. If the engine is shut off in the warm operating state, there is a risk of the engine oil present in the bearing seat being coked. In order to prevent this coking, the bearing seat is actively supplied with coolant from the coolant circuit by the coolant pump and cooled, which makes it necessary for the coolant to emit the heat absorbed in this way from the bearing seat via the heat exchanger back into the environment again.

If the temperature in the coolant circuit falls below the operating opening temperature of the valve element, the valve element, pre-tensioned for example by a return spring, returns to its blocking position, which would lead to the coolant circuit becoming blocked and so the heat from the bearing seat of the charging device would no longer be emitted via the heat exchanger in the coolant circuit. To prevent this, the operating state of the coolant pump supplying coolant to the charging device is monitored and the valve element is held in the open state by means of the actuator when the coolant pump is operating in the pumping mode.

In accordance with a method according to the invention, the operating state of the coolant pump, activated for example by a thermostatic switch in the region of the bearing seat of the charging device, is detected. When the latter is operating, the actuator of the control valve is activated to open the valve element below the operating opening temperature also, so that the control valve remains in an open position and is guiding the coolant flow through the heat exchanger; thus the bearing seat can continue to be actively cooled even if the temperature of the coolant in the coolant circuit has dropped below the opening operating temperature of the control valve.

In addition to the detection of the operating state of the coolant pump for the bearing seat, according to an extension or further development of the invention it is also provided that the valve element is actuated by the actuator if the opening position of the valve element is less than or equal to a predetermined threshold value of the opening position. In other words, this means that the opening position of the valve element is also monitored during the operation of the coolant pump, and the actuator activates the valve element to open it if the opening position which was determined has fallen below a predetermined opening position, because the return spring has activated the valve element back in the direction of its blocking position. Such actuation of the actuator to increase the size of the opening passage of the valve element does not occur only when the valve element has assumed its blocking position, but rather at the point when the valve element moves in the direction of the blocking position but has not yet reached it. This ensures that no interruption to the flow of coolant through the heat exchanger takes place when the coolant pump is pumping. A corresponding control of the actuator to keep the valve element open can therefore already take place when the flow cross-section in the thermostatic valve has not yet been fully closed again by, for example, the return spring, in order to prevent an accumulation of heat in the coolant circuit.

A method according to the invention for monitoring the opening state of the control valve is characterized by the fact that the actual value of the position of the valve element before starting the combustion engine is detected, and compared with the target value. The expression "starting of the combustion engine" is understood quite generally to mean a change of operating mode of the combustion engine, in which the latter transfers from the non-powered state into the powered state. A trigger signal for carrying out the method according to the invention can, for example, be an enabling signal for the activation of an electric starter motor of the combustion engine, or an enabling signal for a fuel conveyor pump of the combustion engine, or even quite generally, a trigger signal derived from the activation of the on-board voltage network of the vehicle.

The invention also provides a device for carrying out the method. Device or apparatus has: a thermostatic valve with a valve plate that is displaceable by means of a spring-loaded positioning element in the coolant passage to or from a heat exchanger of a coolant circuit of a combustion engine; a wax element to which heat can be applied by means of an electrically actuatable heating element which actuates the positioning element; a sensor which detects the distance travelled by the valve plate and/or positioning element by contactless means; and a device for comparing an actual value of the distance travelled with a target value of the distance travelled.

The thermostatic valve therefore has a spring-loaded positioning element for displacing the valve plate and is arranged in the coolant circuit upstream, i.e. in the flow direction of the coolant circuit in the supply line to the heat exchanger, or downstream, i.e. in the flow direction of the coolant circuit in the return line away from the heat exchanger. By means of the valve plate, the coolant flow to or away from the heat exchanger can be influenced by the fact that the displacement motion of the valve plate completely blocks or completely opens a through passage in a housing of the thermostatic valve, or occupies a position between these two extreme positions. The actuating element can be a sleeve which receives the wax element and which is filled with the wax as an expansion medium, which is braced against the heating element. If the wax expands, this causes the wax to rest against the front face of the heating element, which remains stationary, inducing in turn a reaction force which displaces the sleeve along with the valve plate. The actuating pin can also be arranged with the valve disc so that they are displaceable together, such that the expanding wax moves the actuating pin together with the valve plate.

In both cases, the wax element is heated by the coolant and expands in response to the supply of heat, so that the expansion motion of the wax element induces a displacement motion, which displaces the valve plate in the housing of the thermostatic valve against the action of a return spring. The displacement acts to change the cross-section of the passage through which fluid can flow. If heat is applied to the wax element by means of the electrically actuatable heating element, this leads to an opening motion of the valve plate opposite to the action of the return spring, regardless of the temperature of the coolant. By supplying the electrical heating element with short current pulses, a displacement motion of the actuator pin, and therefore of the valve plate, can be triggered. The displacement is detected by the sensor used for contactlessly detecting the position of the valve plate, and recorded by the device for comparing an actual value for the distance travelled with a target value for the distance travelled.

This means it can be verified that the valve plate of the thermostatic valve is not stuck in a blocking position, which would increase the risk of the combustion engine overheating. Using a zero distance measurement of the valve plate it can also be verified that the valve plate is in the blocking position and therefore not sticking in an open position. A valve plate stuck in an open position would lead to an unwanted heat dissipation via the heat exchanger of the coolant circuit during the warm-up procedure of the combustion engine.

Attention is advanced to the drawing figures. FIG. 1 of the drawing shows a schematic representation of a coolant circuit 1 of a combustion engine 2, which is an eight-cylinder engine in a V-arrangement (e.g., a "V-8" engine). The coolant circuit 1 includes a primary heat exchanger 3, through which ambient air can flow for emitting heat to the environment, a suction-operated electrical fan 4 being provided for this purpose. The coolant circuit 1 also preferably contains a second heat exchanger 5 for cooling transmission oil, and for this purpose said heat exchanger 5 can emit heat to a third associated heat exchanger 6 through which coolant flows and which is coupled to the primary heat exchanger 3 for exchanging fluid, so that the heat from the transmission oil circuit can be dissipated into the environment. An expansion tank 32 serves as a buffer vessel for the heated coolant as it expands.

A mechanically or electrically actuated coolant pump 7 ensures that the coolant flows through coolant channels 8 of the combustion engine 2, and circulates in the circuit. A housing 9 of the coolant pump 7 has a connection flange 10, which is designed to accommodate a control valve or thermostatic valve 11, which is shown in greater detail by reference to the subsequent figures.

In the embodiment of the thermostatic valve 11 shown in FIG. 1, a valve plate 12 is in the blocking position, i.e. a reverse flow of coolant from the heat exchanger 3 via the coolant return line 20 into a mixing chamber 13 formed in the housing 9 of the coolant pump 7 is not possible; in the position of the thermostatic valve 11 shown in the warm-up phase, the coolant is transported only by the so-called small coolant circuit, which comprises the combustion engine 2 and an air conditioning circuit 15 operated by a coolant pump 14 for the vehicle air conditioning system.

In this warm-up position, the electrical coolant pump 7 is operated at about 10% of its pumping power, to avoid the formation of heat pockets in the coolant channels 8 of the combustion engine 2. A so-called short-circuit plate 16 of the thermostatic valve 1 is located in an open position, so that the circulation of coolant in the small cooling circuit is possible.

Using a sensor 17 the temperature $T_{Mot}$ of the coolant escaping from the combustion engine 2 is measured.

FIG. 2 of the drawing shows a sectional view of the thermostatic valve or control valve 11 in the position occupied in short-circuit operation in the warm-up phase. In this operating position, the coolant escaping from the combustion engine 2 is directed through the open short-circuit plate 16 into the mixing chamber 13 of the control valve 11 and fed out of the mixing chamber 13 again to the feed line 18, visible in FIG. 1 of the drawing. Such flow is in order to re-enter the coolant channels 8 of the combustion engine 2 so that the combustion engine reaches its operating temperature as quickly as possible. As is evident from FIG. 2, coolant already heated by the combustion engine 2 can be directed into the air conditioning circuit 15, and flows back to the mixing chamber 13 again in the return line 19.

The thermostatic valve 11 includes the above-mentioned valve plate 12, which is held in the blocking position by a return spring 21. The control or thermostatic valve 11 has an actuator 22 with which the valve element in the form of the valve plate 12 can be transferred from its blocking position into an open position (which is shown in FIG. 3 of the drawing).

The actuator 22 has a wax element 23, which contains a wax which melts and expands when heated. The wax element is arranged in a sleeve 24, in the interior of which an actuating element 25 in the form of an actuating pin is arranged, the circular-cylindrical end face of which is impinged upon by the expanding wax. Thus when the wax expands, the sleeve 24 is displaced against the action of the return spring 21 and the valve plate 12, coupled to the sleeve 24, is actuated from the blocking position into the open position. In the embodiment shown in the drawing, the actuating pin exercises the function of both the heating element and the function of the actuating element.

In the open position shown in FIG. 3, the return of coolant from the heat exchanger 3 into the mixing chamber 13 is possible via the coolant return pipe 20, and from there back again into the coolant channels 8 of the combustion engine 2 via the feed line 18.

The thermostatic valve 11 has an electrically actuatable heating element 26 (FIG. 3), which can be supplied with voltage via an electrical plug connector 27 from the on-board voltage supply of a vehicle, in order to ensure by means of the heat input into the wax element 23 a displacement motion of the valve head 12 against the action of the return spring 21—which takes place independently of the temperature of the coolant. In this way, via a control operation which is executed, for example, by an electronic control device of the combustion engine 2 not shown in detail, the application of heat to the wax element 23 is carried out under control of an engine map, in order, for example under high loading conditions of the combustion engine 2, to enlarge the opening cross section that can be released by the valve plate 12 and therefore satisfy the increased cooling requirements of the combustion engine 2.

FIG. 4 shows a sectional view of the thermostatic valve 11. Via a supply line 28, coolant can also be introduced into the mixing chamber 13 from the return line of a bearing seat of an exhaust gas turbocharger (not shown in detail) of the combustion engine 2. In the position of the thermostatic valve 11 illustrated, the valve plate 12 is in the blocking position, i.e. in the position which is occupied during the warm-up phase of the combustion engine 2, in which the entry of coolant from the heat exchanger 2 via the coolant return pipe 20 is disabled. The resistance heating element 26 can be energized by way of the electrical plug connector 27, in order to produce an expansion of the expandable substance, in the form of thermal wax, which is held in the sleeve 24.

Attention is invited to FIG. 5, showing a magnified view of a detail in accordance with FIG. 4 of the drawing with the thermostatic valve 11. As can be readily seen, at the upper end region of the wax element 23 a sealing cap 32 is provided, which closes off the wax-filled sleeve 24. Above the sealing cap 33 a permanent magnet 29 is arranged, the distance of which from a sensor 30, provided in the form of a Hall sensor in the embodiment shown, and thus the position of which relative to the sensor 30, can be determined contactlessly (without direct contact) by detecting the field strength of the permanent magnet 29. The permanent magnet 29 has an inner recess into which an O-ring 35 can be inserted, which fixes the magnet 29 in place by means of a circlip 36. Electronic circuit components 37 can be integrated into the housing 34 of the plug connector 27 for recording the sensor voltage which results from a change in the position of the permanent magnet 29 relative to the sensor 30, and varies as a function of the displacement of the sleeve 24, and therefore of the valve head 12.

The distance between the permanent magnet 29 and the sensor 30, when valve plate 12 is located in the blocking position, is known on the basis of design data. The method according to the invention can be used to determine whether the valve plate 12 is in the blocking position, by comparing the actual value of the distance from sensor 30 to valve head 12 corresponding to the position of valve plate 12 as measured by sensor 30, with the distance value corresponding to the blocking position of valve head 12 as a reference value. If the actual value thus measured by sensor 30 is within a tolerance range of measurement about the reference value, then valve plate 12 is in the desired blocking position so that an unwanted dissipation of heat via the heat exchanger 3 during the warm-up procedure of the combustion engine 2 is prevented.

Accordingly, even before starting the combustion engine 2, i.e. before it is powered and thus even starts to generate pollutant emissions at all, whether the valve plate 12 is in the desired target blocking position or not can be determined. According to the previously known method mentioned previously hereinabove, the verification of whether the valve plate 12 is in the target blocking position or not takes place during the warm-up procedure of the combustion engine 2, and thus takes a period of several minutes. But according to the method of this invention, it is advantageously already carried out before the combustion engine is powered, without any pollutant emissions having to be released to do so.

In addition, according to an advantageous extension of the method according to the invention, even before the combustion engine is started, it can be determined whether the valve plate 12 is in a "stuck closed" position, which would entail the risk of the combustion engine 2 overheating. For this purpose, it is provided to energize the actuator in the form of the electrically heatable wax element 23 to produce a change in the position of the valve head 12 which is detectable by the sensor 30. Consequently, the valve plate 12 is displaced exactly so far, i.e. it is moved from a position which blocks the passage of coolant through the flow cross section 31 (FIG. 3) towards a position which releases the flow cross-section 31, that the sensor 30 can detect the change in position of the valve plate 12 within its measurement resolution range. If this minimally detectable change in position is so small that an elastomer component (not shown in detail) which is formed on the valve plate 12 and pre-tensioned in the direction of the blocking position, still closes off the flow cross-section 31 even after carrying out the minor change in position of the valve head 12, then even if the combustion engine is started immediately thereafter, this verification of the free movement of the valve plate 12 does not lead to any unwanted dissipation of heat via the heat exchanger 3.

In addition, a displacement of the valve plate 12 towards the "open" position of the flow cross-section 31, by pulsing of the heating element 26 during this verification process, does not lead to a significant amount of heat loss via the heat exchanger 3, because after pulsing of the heating element 26 the valve plate 12 is immediately displaced by the return spring 21 towards the blocking position.

The method according to the invention therefore makes it possible to detect both the position of the valve head 12 in the "stuck open" position, enabling an unwanted dissipation of heat via the heat exchanger 3 during the warm-up process of the combustion engine 2, as well as the equally undesirable "stuck closed" state of the valve head 12 in the blocking position, even before the combustion engine 2 is even started.

According to another extension of a method according to the invention, it is also possible to monitor the opening state of the thermostatic valve 11 with the thermostatic valve in the blocking position as intended when the combustion engine 2 has already almost completed the warm-up process and the valve 11 has not yet reached the operating opening temperature, or the temperature of the coolant (and thus of the thermostatic valve 11) has not fallen back below the operating opening temperature of the thermostatic valve due to the combustion engine 2 being powered off for a period of time. Such a situation can occur, for example, in the case of vehicles with start-stop systems, in which even before reaching the operating opening temperature of the thermostatic valve 11, the combustion engine 2 is transferred from the powered state into the non-powered state (e.g., when the vehicle is at a red traffic light).

Verification as to whether the valve plate 12 is able to be displaced or is, say, stuck in the proper blocking position, can also be performed in accordance with an action initiated by the user of a vehicle. Thus, the pulsing of the heating element 26, and therefore the checking of the valve head 12, can be triggered if the user selects a "sports driving" program provided by the vehicle at a coolant temperature below the operating opening temperature of the thermostatic valve 11—i.e. for example, chooses gear-shifting characteristics of the vehicle gearbox with shift points at high engine speeds. In such a case where a high load demand is expected on the combustion engine 2, the proper function of the valve head 12 to be opened can be verified, even before the coolant temperature increases due to the high load requirement.

The method according to the invention for monitoring the opening position of the valve plate 12 in the blocking position can then be triggered, for example, by an enabling signal for the electric starter motor of the combustion engine 2, and it can then be verified whether the valve plate 12 below the operating opening temperature of the thermostatic valve 11 is in the blocking position as intended. Also, by briefly energizing the heating element 26, it can be verified whether the thermostatic valve 11 located in the blocking position is able to be opened as intended, i.e. whether the valve plate 12 can be displaced from the blocking position towards a position which releases the flow cross-section 31, thus preventing overheating of the combustion engine 2.

In the case that the result of the verification in all the above cases shows that the valve plate 12 is in a "stuck open" position, a fault entry can be recorded in the vehicle-internal fault memory, which results in a corresponding maintenance alert for the thermostat valve 11. Also, a fault entry indicating the specific maintenance alert "thermostat valve stuck closed" can be recorded in the fault memory if the valve plate 12 cannot be displaced by pulsing the heating element 26 as intended to produce a change of position which is detectable by the sensor 30.

FIG. 6 of the drawing illustrates a flow chart for explaining the method according to the invention. The sensor 30 outputs a voltage signal depending on the measured field strength, which indicates the distance of a permanent magnet 29 from sensor 30, and thereby the position of the valve element in the form of valve plate 12 relative to sensor 30. In this embodiment, the implementation of the method according to the invention is controlled by a control device of the combustion engine 2. In a step S1, triggered by a signal indicating the energizing of the electric starter motor of the combustion engine 2, the distance from permanent magnet 29 to sensor 30 is measured by means of sensor 30. Then in a step S2, a reference value corresponding to the blocking position of the valve plate 12 is read out of a vehicle memory. In a next step S3, the actual value of the position of the valve plate 12 thus measured is compared to the reference value. If it is determined that the valve plate 12 is in its proper blocking position, then in a next step S4 an entry "OK" is recorded in the vehicle memory.

If in step S3, on the other hand, it is determined that the valve plate 12 is not in its proper blocking position, then in a step S5 a corresponding fault entry is recorded in the vehicle-internal fault memory, and a service alert is output on a vehicle-internal display device for the user of the vehicle.

In a next step S6 according to an extension or further development of the method according to the invention, after the presence of an "OK" condition has been detected in step S4, the engine control unit outputs a signal to a control device for energizing the heating element 26 to carry out a brief heating of the wax element 23; then in a next step S7 the actual value of the position of the valve plate 12 is determined, and after that, in a next step S8, the actual value thus measured is compared with the reference value already known from step S2.

If it is found that the actual value of the position of the valve plate 12 differs from the reference value, an "OK" entry will be recorded in the vehicle memory in a next step S9. If in step S8, on the other hand, it is determined that the actual value of the valve plate 12 still matches the reference value, in a step S10 a corresponding fault entry is recorded in the vehicle-internal fault memory and a servicing alert is output to the user of the vehicle.

With regard to features of the invention not described in detail individually, express reference is made to the patent claims and the drawing.

| List of reference numerals |
|---|
| 1. Coolant circuit |
| 2. Combustion engine |
| 3. Heat exchanger |
| 4. Fan |
| 5. Heat exchanger |
| 6. Heat exchanger |
| 7. Coolant pump |
| 8. Coolant channels |
| 9. Housing |
| 10. Connecting flange |
| 11. Control valve, thermostatic valve |
| 12. Valve plate, valve element |
| 13. Mixing chamber |
| 14. Coolant pump for vehicle air conditioning |
| 15. Air-conditioning circuit |
| 16. Short-circuit plate |
| 17. Sensor |
| 18. Feed line |
| 19. Return line |
| 20. Coolant return pipe |
| 21. Reset spring |
| 22. Actuator |
| 23. Wax element |
| 24. Sleeve |
| 25. Actuating element |
| 26. Heating element |
| 27. Plug connector |
| 28. Supply pipe |
| 29. Permanent magnet |
| 30. Sensor |
| 31. Flow cross-section |
| 32. Expansion Tank |
| 33. Sealing cap |
| 34. Housing |
| 35. O-ring |
| 36. Circlip |
| 37. Circuit Components |

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of controlling a control valve (11) of a coolant circuit (1) of a combustion engine (2), said control valve (11) having a valve element (12) that is actuatable by an actuator (22) for enabling and/or blocking a flow of a coolant in the coolant circuit (1) which has a heat exchanger (3), and having a device for detecting the position of the valve element for monitoring the opening state, characterized in that by the device a first actual value representing the position of the valve element (12) before a starting of the combustion engine (2) is detected and the first actual value is compared with a reference value which corresponds to a blocking position of the valve element (12).

2. The method according to claim 1, characterized in that if the first actual value deviates from the reference value, a fault entry is recorded in a fault memory.

3. The method according to claim 1, characterized in that before the starting of the combustion engine (2) the valve element (12) is actuated by the actuator (22) to produce a detectable change in the position of the valve element (12).

4. The method according to claim 3, characterized in that a target value corresponding to a changed position of the valve element (12) is compared with the actual value detected by the device, and in the event of a deviation of the target value from the actual value, a fault entry is recorded in a fault memory.

5. A device for carrying out the method according to claim 4, characterized by a thermostatic valve (11) having a valve plate (12) displaceable by means of a spring-loaded positioning element in the coolant passage to or from a heat exchanger (3) of a coolant circuit (1) of a combustion engine (2), and having a wax element (23) to which heat is applicable by means of an electrically actuatable heating element (26) and which actuates the positioning element, and having a sensor (30) which detects the travelling distance of the valve plate (12) and/or positioning element by contactless means, and with a means device for comparing an actual value of the travelling distance with a target value of the travelling distance, the device being adapted to comparing said actual value and said target value in a condition of the combustion engine before being powered.

6. The method according to claim 3, characterized in that the valve element (12) is actuated by the actuator (22) when a coolant temperature detected in the coolant circuit (1) is below a predetermined threshold value.

7. The method according to claim 6, characterized in that the threshold value is less than or equal to a normal operating opening temperature, subject to a tolerance range, of the valve element (12).

8. The method according to claim 7, characterized in that an operating state of a coolant pump supplying coolant to a charging device of the combustion engine (2) is detected, and the valve element is actuated by the actuator (22) depending on the detected operating state to induce an opening position of the valve element (12).

9. The method according to claim 8, characterized in that the coolant is pumped at least to a storage device of the charging device, and the valve element is actuated by the actuator (22) if the opening position is less than or equal to a predetermined threshold value of the opening position.

10. The method according to claim 1, characterized in that a temperature of the coolant is detected and the first actual value is detected at least until the temperature has reached a predetermined temperature threshold.

11. The method according to claim 1, characterized in that the monitoring is triggered by a trigger signal initiating the starting of the combustion engine (2).

12. A device for carrying out the method according to claim 1, characterized by a thermostatic valve (11) having a valve plate (12) displaceable by means of a spring-loaded positioning element in the coolant passage to or from a heat exchanger (3) of a coolant circuit (1) of a combustion engine (2), and having a wax element (23) to which heat is applicable by means of an electrically actuatable heating element (26) and which actuates the positioning element, and having a sensor (30) which detects the travelling distance of the valve plate (12) and/or positioning element by contactless means, and with a device for comparing an actual value of the travelling distance with a target value of the travelling distance, the device being adapted to comparing said actual value and said target value in a condition of the combustion engine before being powered.

* * * * *